US005819758A

United States Patent [19]

Sohler

[11] Patent Number: 5,819,758

[45] Date of Patent: Oct. 13, 1998

[54] COMBINATION BRUSH AND COMPLEMENTARY CLEANING COMB

[75] Inventor: Bernard Sohler, Selestat, France

[73] Assignee: Societe Nouvelle Celluloid, France

[21] Appl. No.: 648,194

[22] PCT Filed: Oct. 6, 1995

[86] PCT No.: PCT/FR95/01301

§ 371 Date: Sep. 26, 1996

§ 102(e) Date: Sep. 26, 1996

[87] PCT Pub. No.: WO96/10933

PCT Pub. Date: Apr. 18, 1996

[30] Foreign Application Priority Data

Oct. 7, 1994 [FR] France ..... 94 12250

[51] Int. Cl.[6] ..... A45D 24/16

[52] U.S. Cl. ..... 132/121; 15/105; 15/160; 132/160; 132/148; 132/901; 132/125

[58] Field of Search ..... 132/120, 121, 132/119, 125, 160, 147, 148, 901, 150, 313; 15/105, 160, 104.5, 104.53

[56] References Cited

U.S. PATENT DOCUMENTS

| | | | |
|---|---|---|---|
| 104,202 | 6/1870 | Reed | 132/160 |
| 684,172 | 10/1901 | Bick | 132/121 |
| 823,464 | 6/1906 | Eggers | 132/121 |
| 952,491 | 3/1910 | Youngs | 132/901 |
| 1,220,105 | 3/1917 | Hart | 15/104.5 |
| 1,401,576 | 12/1921 | Babirad | 132/121 |
| 3,406,694 | 10/1968 | Odence | 132/313 |
| 3,444,866 | 5/1969 | Battaglia | 132/126 |

FOREIGN PATENT DOCUMENTS

| | | | |
|---|---|---|---|
| 219764 | 2/1962 | Austria | 132/125 |
| 547100 | 10/1957 | Canada | 132/126 |
| 429912 | 10/1911 | France . | |
| 1269460 | 8/1961 | France . | |
| 1356900 | 3/1964 | France . | |
| 2467566 | 4/1981 | France . | |
| 57294 | 7/1891 | Germany . | |
| 127527 | 6/1901 | Germany . | |
| 811603 | 8/1951 | Germany . | |
| 2551963 | 6/1977 | Germany . | |
| 552091 | 11/1956 | Italy | 132/126 |

*Primary Examiner*—Todd E. Manahan
*Assistant Examiner*—Eduando C. Robert
*Attorney, Agent, or Firm*—Parkhurst & Wendel, L.L.P

[57] ABSTRACT

A combination brush and cleaning comb to remove hair and other debris from the bristles. The cleaning comb is specially sized to have teeth that are complementary or slightly larger than the space between the bristles, allowing for minimal effort when cleaning. The matched sizing also reduces the possibility of damage to the bristles. The handle of the brush contains an ergonomically designed enclosure to store the cleaning comb without affecting the feel of the handle.

1 Claim, 6 Drawing Sheets

COMBINATION BRUSH AND COMPLEMENTARY CLEANING COMB

The invention relates to a new type of brush; containing a specially designed cleaning comb.

BACKGROUND OF THE INVENTION

As is known, it is not always very easy to remove hairs or the like caught between the teeth of a comb, especially when these tufts of hair have been extracted from the bristles of a brush by the comb. These tufts usually are pulled off by hand and, depending on how tangled they are, are more or less difficult to remove.

Removing hair from a brush is also difficult as one does not always have an article such as a comb in hand. An accumulation of hair in a brush is unsightly and reduces the effectiveness of the brushing action. Even apart from this, cleaning a brush is a long, tedious process.

If a comb is used to clean the brush, the task is made difficult by the fact that the shape and spacing of the teeth are not designed for this operation, as a result of which cleaning is time-consuming and imperfect. The hairs have to be removed from the comb afterwards, which, depending on the comb used, can be a difficult process too. Moreover, the use of an ordinary comb for this operation can damage the brush.

Document FR-A-429 912 describes a composite instrument forming a shoehorn, one end of which forms a comb having bent metal teeth. This instrument can be used for extracting hairs caught in a brush, but unfortunately the shape of the teeth comprises a right angle which does not enable the hairs to be grasped effectively or pulled off with ease. Moreover, and more importantly, cleaning a brush necessitates having this cumbersome instrument in hand.

Again, document FR-A-2 467 566 describes a combination of a brush and a comb for styling the hair. On the back of the brush is a series of straight ribs equal in width to the unoccupied space between two consecutive teeth of the comb. When the teeth of the comb are inserted between the ribs, the comb is secured to the brush. Unfortunately, in order for it to fit, it is necessary to use a styling comb with conventional straight teeth, and it has been seen above that such teeth are not good at removing hair caught on a brush. Also, the presence of the comb on the top of the brush makes the handle very uncomfortable to hold, which is no doubt why this device has not reached the marketplace.

The problem which the invention seeks to solve is the efficient cleaning of brushes, combined with the problem of the ergonomics of such a brush.

DESCRIPTION OF THE INVENTION

The invention relates to a brush of the type that comprises a handle and a head, with at least one side thereof having a plurality of bristles, the said brush being fitted with a comb formed by a body having an unoccupied outward side and an inward side, and by a plurality of teeth joined to the inward side of this body.

This brush is characterized:

- in that the comb is located removably in a housing provided for this purpose in the handle and opening onto one of the sides of the handle,
- in that the outward side of the comb lies flush with the surface of the handle when it is positioned within the housing, and has means for holding it in place and for releasing it from the handle,

- and in that the free ends of the teeth are all bent at approximately right angles to their longitudinal axis.

In other words, the object of the invention is a brush containing in its handle a removable and retractable cleaning comb, the free ends of the teeth of which are bent to enable the comb to be passed through the bristles of the hairbrush in one direction, for extracting the hairs from the brush, and to enable the collected tuft of hairs to be removed by simply turning it in the other direction.

Thus, in the embodiment according to the invention, the brush serves its conventional purpose of styling the hair, whereas the associated comb serves purely as a cleaning accessory and not for hairstyling. In addition, since the outward side of the body of the comb lies flush with the surface of the handle, the person using the brush is not inconvenienced by the presence of the comb as the latter is fully ergonomically hidden within the handle.

In one practical embodiment, each tooth of the comb has the general shape of an L comprising a first main arm connected at its end to a secondary arm whose axis is approximately at right angles to the longitudinal axis of the main arm, the inward side of the first arm forming an obtuse angle ($\alpha$) with the inward side of the second arm.

Thus, after collecting the hairs from the brush, these hairs are slid along the two segments forming each tooth. The presence of the obtuse angle means that hairs do not accumulate at the junction between the segments and, which allows for easier cleaning.

Advantageously, in practice:

- this obtuse angle is about 115 degrees;
- the outward side of the main arm is connected to the outward side of the secondary arm by a chamfer, this chamfer forming an angle $\beta$ of about 145 degrees with the outward side of the main arm;
- the outward side of the main arm is inclined at about 5 degrees ($\gamma$) to the longitudinal axis of the main arm;
- the unoccupied space between each tooth measures approximately the same as the width of one tooth;
- each tooth has a flexible rib positioned in the intertooth space and very slightly narrower [lacuna] the intertooth space;
- each tooth has asperities to increase the friction between the hairs and the teeth;
- the end of each tooth is divided into two points in order to increase the chances of hairs being picked up by the teeth.

The user of the brush thus has a convenient and hygienic means at his disposal for removing hairs and suchlike held in the brush. No inconvenience is caused to the grip on the brush by the configuration of the handle and the comb. In this way, when in the inserted position, the comb forms an integral part of the brush.

The space between the comb teeth is advantageously slightly greater than the width of a bunch of bristles.

In a preferred embodiment, the housing consists of a slot formed in the thickness of the handle and extending parallel to the longitudinal axis of the handle, its dimensions coinciding approximately with those of the comb to give a snug fit.

In order to solve the problem of fitting the comb inside the brush, the means for holding the comb in the handle consist of a male part situated on one longitudinal side of the housing, the said part being designed to engage with the secondary arm of at least one tooth of the comb and of a vertical portion of the comb, parallel to the teeth, and comprising at its free end a stud designed to engage with an opening on the side of the handle opposite the side containing the opening of the housing.

In order to solve the problem of how to extract the comb from the brush, the means for releasing the comb from the housing consist of a recessed elliptical portion in the side of the handle opposite the housing opening, which recessed portion fits the shape of the inside end of the thumb, and is joined smoothly to the opening, to permit pressure on the vertical portion.

Advantageously, in practice, the housing includes receptically designed parts that engage protruding parts, in order to hold the comb in the housing and enable it to be released (or put back in position) very easily.

The way in which the invention can be carried out and the advantages procured thereby will be demonstrated more clearly in the following example of an embodiment and the attached supporting figures.

EMBODIMENTS OF THE INVENTION

Figure 1:
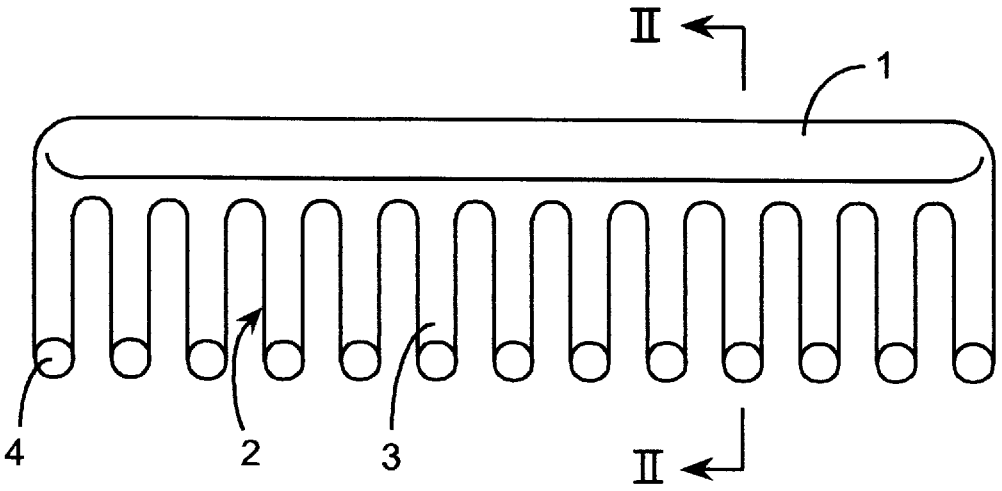
FIG. 1 is a schematic view of a comb according to the invention.
Figure 4:
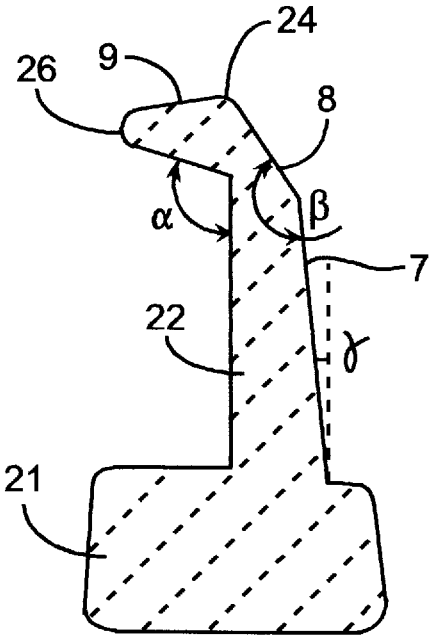
FIG. 4 is a sectional view on a large scale on the line IV–IV' shown in FIG. 3 of a tooth that is characteristic of the invention.
Figure 2:
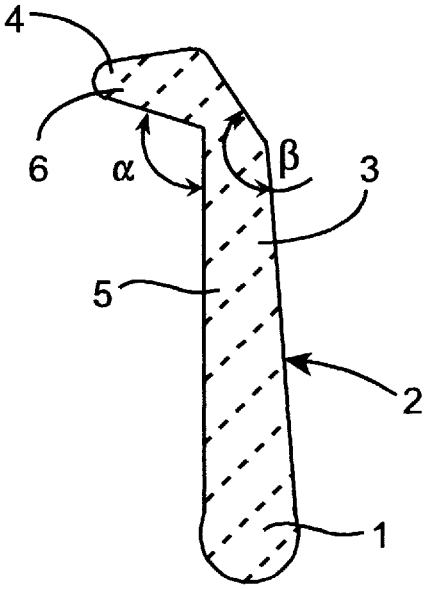
FIG. 2 is a sectional view on a large scale of a tooth on the line II–II' of FIG. 1.

The comb according to the invention shown in FIGS. 1 and 2 comprises a body (1) and a plurality of parallel teeth (2).

A first feature of the invention is that the secondary arms (4) (see FIG. 2) of the teeth (2) are all bent in the same direction.

In the practical embodiment shown in FIG. 2, each tooth (2) has the general shape of an L comprising a first main arm (3) connected at its base to the body (1) and connected at its free end to a secondary arm (4), the axis of which is approximately at right angles to the longitudinal axis of the main arm (3). The inward side (5) of the first arm (3) forms an obtuse angle a with the inward face (6) of the secondary arm (4). In one practical embodiment, this angle $\alpha$ is about 115 degrees.

In addition, the outward side (7) of the main arm (3) is connected to the outward side (9) of the secondary arm (4) by a chamfer (8), this chamfer forming an angle $\beta$ of about 145 degrees with the outward face (7) of the main arm (3).

Lastly, the outward side (7) of the main arm (3) is inclined at about 5 degrees ($\gamma$) to the longitudinal axis of the main arm (3).

Figure 5:
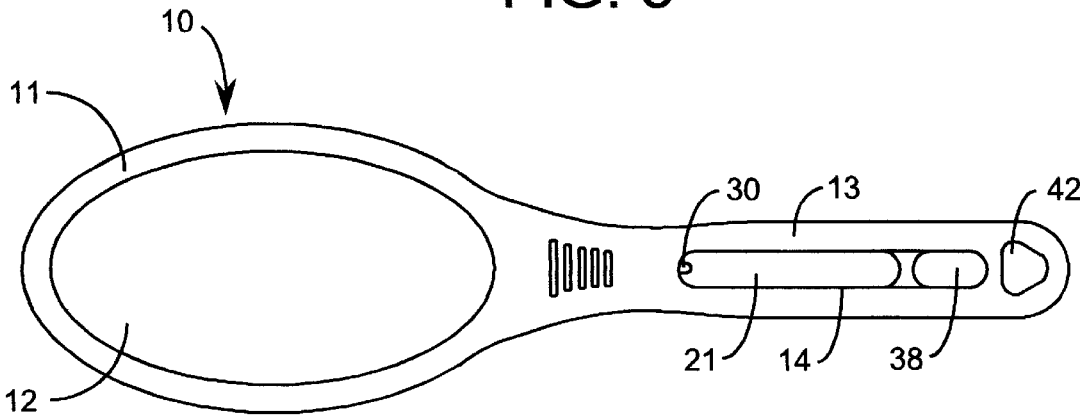
FIGS. 5 and 6 respectively show a top view and a bottom view of a brush comprising such a comb.
Figure 6:
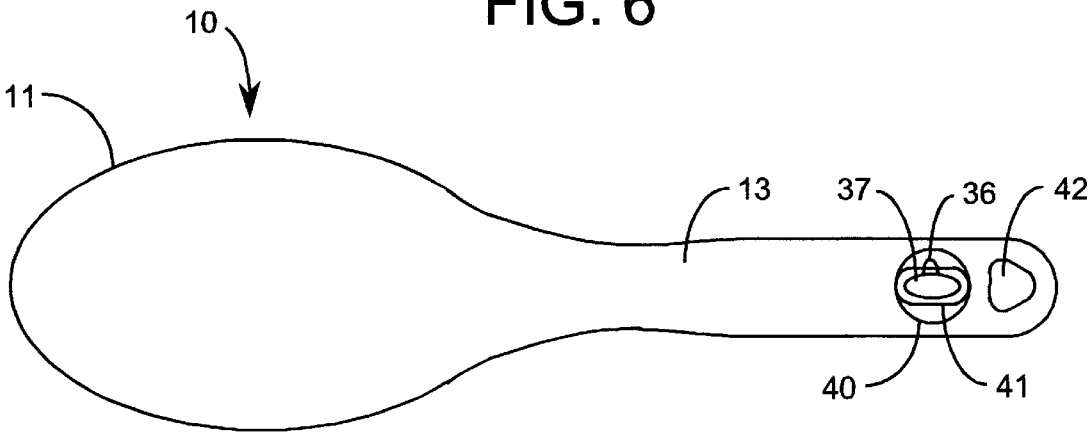
Figure 7:
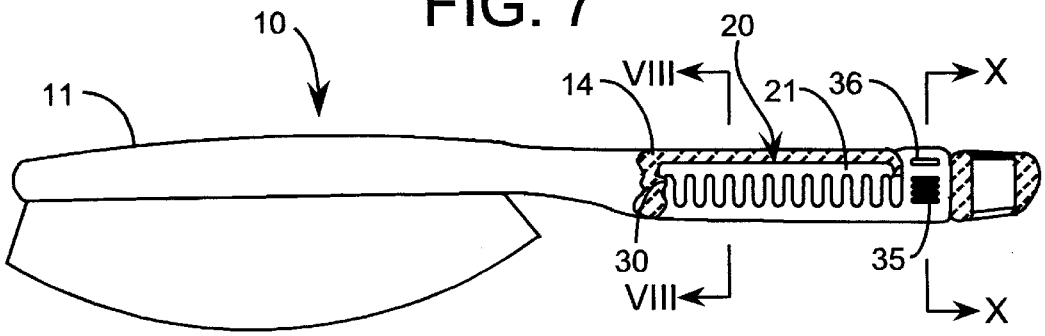
FIG. 7 is a view in partial section showing the handle and the comb that are characteristic of the invention.
Figure 8:
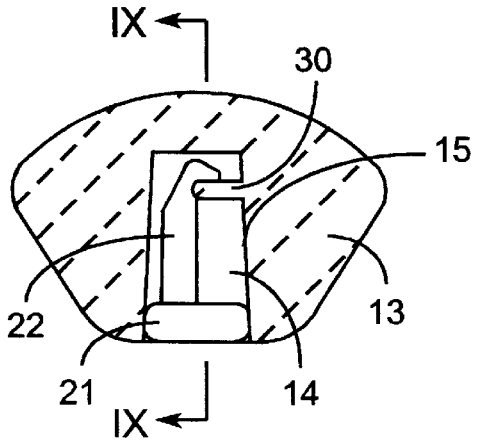
FIG. 8 is a sectional view on the line VIII–VIII" marked in FIG. 7, illustrating the locking of the comb by means of a lug.

The invention also relates to a brush (see FIGS. 5–7) indicated by the general reference (10), comprising a head (11) with bristles (12) and a handle (13).

Figure 3:
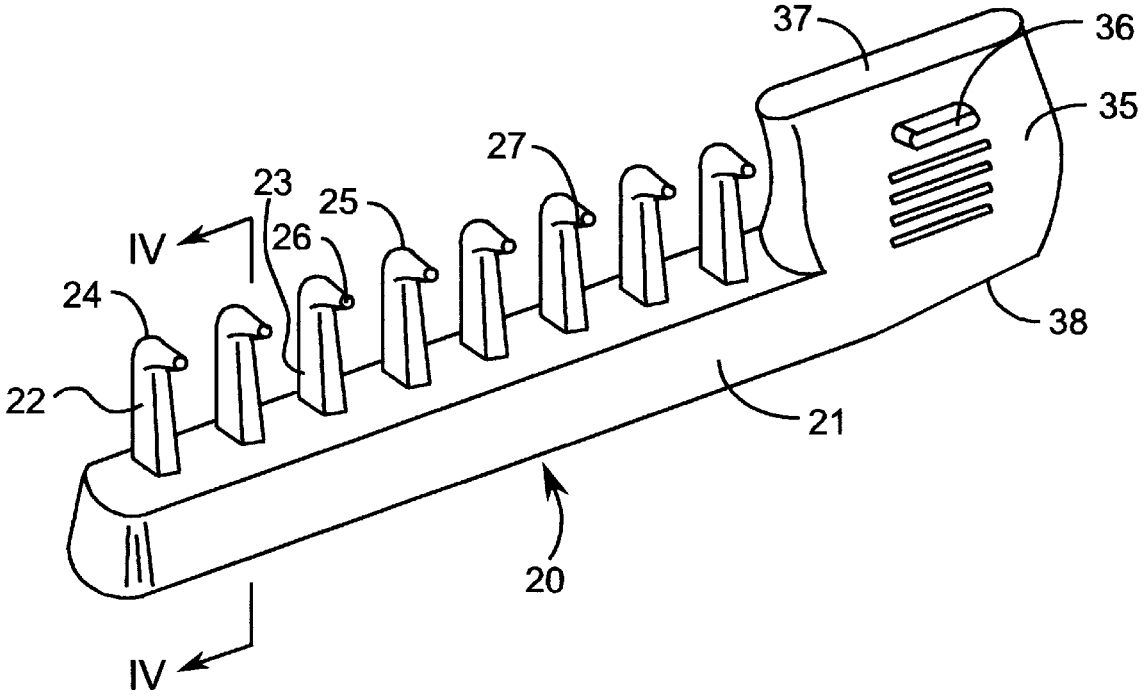
FIG. 3 is a simplified perspective view of a comb that fits in the handle of a brush.
Figure 9:
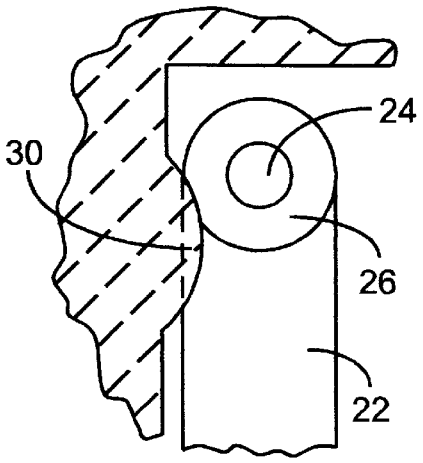
FIG. 9 is a view partly in section and on a large scale, on the line IX–IX' marked in FIG. 8, showing the locking of the comb by a lug engaging with the last tooth.
Figure 10:
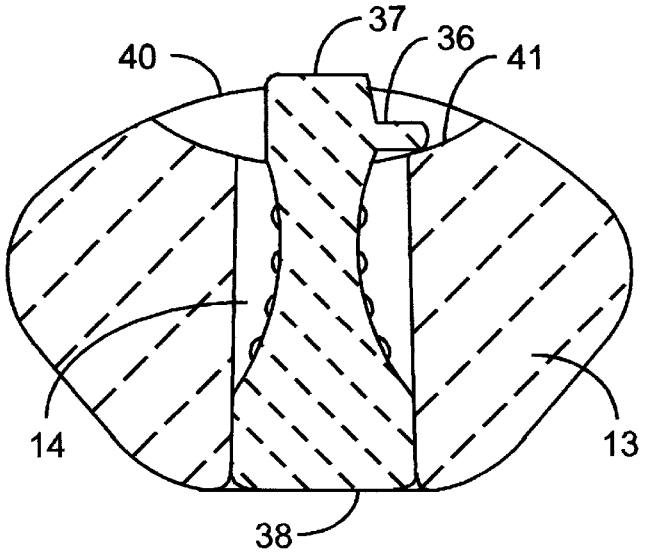
FIG. 10 is a sectional view on a large scale on the line X–X' shown in FIG. 7 illustrating the locking of the end block of the comb.

One feature of the invention is that this handle (13) contains a housing (14) into which a comb illustrated in FIG. 3, and denoted by the general reference (20), is fitted. This comb (20) comprises firstly a base (21) similar to (1), slightly flared, and having a plurality of teeth (22, 23) whose free ends (24, 25) are all bent (26, 27) in the same direction. As in FIG. 2, the angle $\alpha$ is about 115 degrees. The housing (14) formed in the thickness of the handle (13) extends parallel to the longitudinal axis of this handle (13) and its dimensions coincide approximately with those of the comb so that it can be fitted snugly (see FIG. 7) in the thickness of the handle. To make this snug fit possible, the housing (14) comprises, firstly, toward the front and on the bottom, a lug (30) designed to engage with the bent part (26) of the tooth (22) situated at the front end of the comb (20) (see FIG. 9). The comb (20) also has at the rear a vertical portion (35) parallel to the teeth (22) and having at its free end a stud (36). The references (37, 38) denote the two sides of this lateral portion (35). The end (37) emerges on the opposite side of the handle through an opening (40) provided for this purpose to accommodate the vertical portion (35) which is introduced into it. The opening is joined smoothly to an ellipse (41) that fits the shape of the inside end of the thumb, to enable the comb (20) to be released by simple pressure in this ellipse (41).

The reference (42) denotes an opening from which the hairbrush (10) can be hung.

In this practical embodiment, the comb (20) is locked inside the handle (13) by the lug (30) formed for this purpose on the wall (15) of the housing (14) pointing toward the front of the brush and retaining the bent end of the last tooth, and also by means of the stud (36) engaging with the opening (40).

When the brush (10) is in use, the comb (20) is held inside the housing (14). When brushing is over, the user releases the comb (20) by pressing on the end (37) through the elliptical opening (41). Once the comb is removed it is simply passed through the bristles (12) of the brush, bent teeth (26) foremost so as to pick up all the hairs caught in the brush. The cleaning action is more effective if the teeth comprise a number of obstacles suitable for holding onto the hairs.

Figure 11:
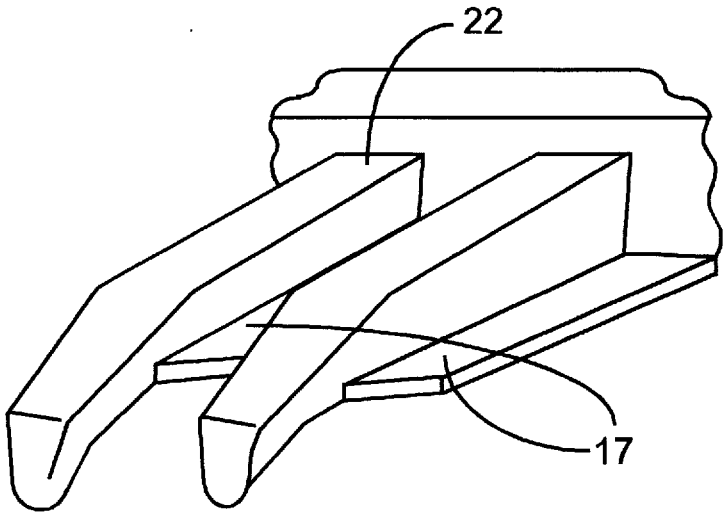
FIG. 11 is a perspective view of part of the comb showing two teeth each equipped with a rib.
Figure 12:
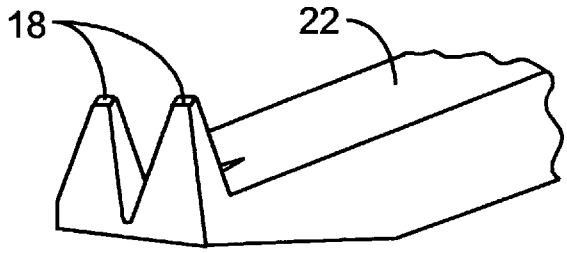
FIG. 12 is a detail perspective view of a tooth whose end divides into two points.
Figure 13A:
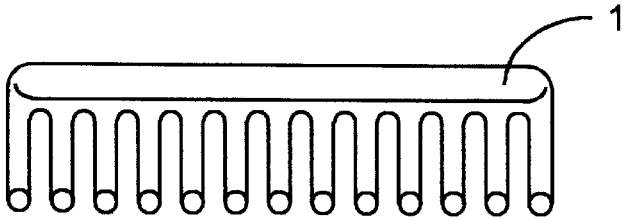
FIGS. 13(*a*) and 13(*b*) depict an embodiment showing the comb having spaces between its teeth that are slightly wider than the bristles 12, of the brush respectively.
Figure 13B:
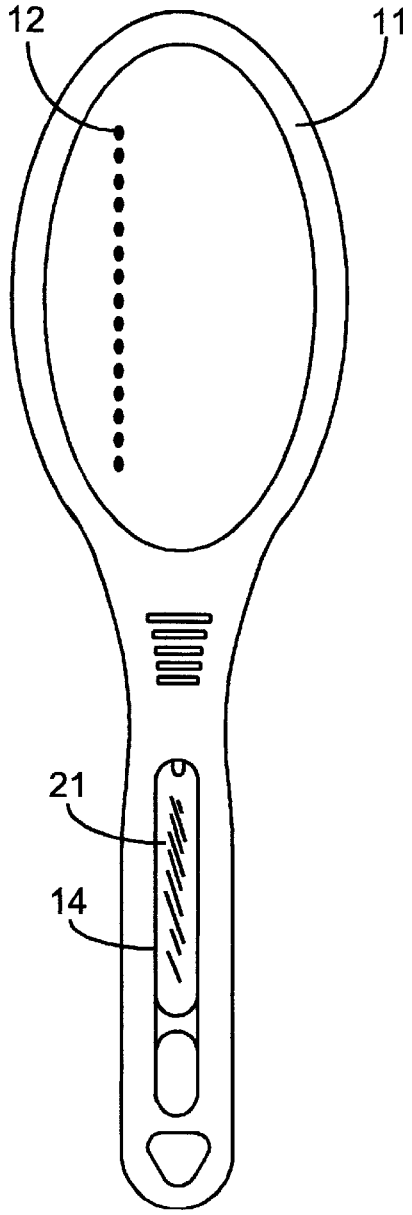

These may be ribs (17) belonging to each tooth and defining a narrow space between each tooth, suitable for trapping the hairs (see FIG. 11). The teeth may also include asperities or roughnesses designed to catch the hair. In another variant, the end of each tooth has two points (18), thus doubling the number of catching points (see FIG. 12).

After the cleaning operation has been completed, all that is required is to move the resulting tuft back in the other direction in order to remove it with ease. Removal is facilitated by the obtuse angle $\alpha$ which allows the hairs to be slid easily from the inward side (5) of the main arm (3) toward the inward side (6) of the secondary arm (4). At the same time the chamfer (8) allows the hand to follow the external contour of the teeth, thus smoothly accompanying the hairs as they are withdrawn. This leads consequently to better hygiene and greater cleanliness.

Although, in the illustrative embodiment, the comb has been described in its application to a hairbrush, it is self-evident that such a comb can also be applied in other ways for any type of brush that may collect bristles, filaments or waste of any kind. It can therefore be used for any kind of instrument comprising a handle and fitted with bristles or fibers, such as for example in combination with brushes for grooming animals, such as horses, or for clothes brushes, artists' and decorators' brushes or for cleaning the bristles of a broom.

The shape and dimensions, and the manner and position of fixing, are of course different from those in the example described above, and depend on the application, but still form part of the scope of the invention.

It will be seen from the above that the cleaning comb and the brush of the invention, especially when combined, enable the brush to be cleaned easily and effectively without the need for a complementary implement, since this is concealed in the handle of the brush.

I claim:

1. A brush and detachable cleaning comb comprising:

a handle containing a housing;

a head attached to an end of said handle;

a plurality of bristles attached to one side of the head;

a cleaning comb having an inward and outward side, said cleaning comb removably fitted within said housing in said handle open toward a side of said handle;

a plurality of teeth, each tooth of said plurality of teeth comprising a first main arm joined on one end to the inward side of said cleaning comb, and a secondary arm joined on an opposite end of the first main arm in a general L-shape, wherein a longitudinal axis of the secondary arm is approximately at a right angle to a longitudinal axis of said first main arm; and means for attaching or detaching said cleaning comb from the housing in said handle; wherein said cleaning comb lies flush with the outward side of the surface of said handle when fitted within the housing of said handle;

said means for attaching or detaching said cleaning comb in the handle comprises a male part situated on one longitudinal side of the housing, the male part being engageable with the secondary arm of at least one tooth of said cleaning comb; and said cleaning comb includes a vertical portion, parallel to said plurality of teeth, said vertical portion comprising at its free end a stud engageable with an opening on the side of the handle opposite the side containing the opening of the housing.

* * * * *